US006639576B2

(12) United States Patent
Miyazawa et al.

(10) Patent No.: US 6,639,576 B2
(45) **Date of Patent: *Oct. 28, 2003**

(54) DISPLAY DEVICE

(75) Inventors: Toshio Miyazawa, Chiba (JP); Tomohiko Sato, Chiba (JP)

(73) Assignee: Hitachi, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/222,996

(22) Filed: Aug. 19, 2002

(65) Prior Publication Data

US 2002/0196247 A1 Dec. 26, 2002

Related U.S. Application Data

(63) Continuation of application No. 09/588,665, filed on Jun. 6, 2000, now Pat. No. 6,445,371.

(30) Foreign Application Priority Data

Jun. 9, 1999 (JP) ..... 11-162268

(51) Int. Cl.[7] ..... G09G 3/36
(52) U.S. Cl. ..... 345/92; 345/95
(58) Field of Search ..... 345/87, 90, 92, 345/94, 98, 99, 100, 95; 349/41, 42

(56) References Cited

U.S. PATENT DOCUMENTS

| | | | | |
|---|---|---|---|---|
| 5,166,960 A | * | 11/1992 | Da Costa | 377/70 |
| 5,237,346 A | * | 8/1993 | Da Costa et al. | 347/148 |
| 5,627,557 A | | 5/1997 | Yamaguchi et al. | 345/90 |
| 5,646,642 A | | 7/1997 | Maekawa et al. | 345/99 |
| 5,648,790 A | * | 7/1997 | Lee | 345/58 |
| 5,808,595 A | * | 9/1998 | Kubota et al. | 345/92 |
| 6,081,131 A | | 6/2000 | Ishii | 326/68 |
| 6,104,040 A | * | 8/2000 | Kawachi et al. | 257/59 |
| 6,127,997 A | | 10/2000 | Tsuchi | 345/98 |
| 6,278,426 B1 | * | 8/2001 | Akiyama | 345/87 |
| 6,292,183 B1 | | 9/2001 | Yamazaki et al. | 345/211 |
| 6,297,793 B1 | | 10/2001 | Kawahata | 345/98 |
| 6,362,798 B1 | | 3/2002 | Kimura et al. | 345/55 |
| 6,445,371 B1 | * | 9/2002 | Miyazawa et al. | 345/92 |

* cited by examiner

*Primary Examiner*—Amare Mengistu
*Assistant Examiner*—Jeff Piziali
(74) *Attorney, Agent, or Firm*—Antonelli, Terry, Stout & Kraus, LLP

(57) ABSTRACT

A display device includes a latch circuit storing digital data, a converter circuit converting the digital data stored in the latch circuit to an analog signal, a voltage regenerating circuit inputting the analog signal and outputting a video signal, and an image signal line supplied the video signal. The voltage regenerating circuit includes six TFTs wherein the TFTs are connected in a particular manner.

19 Claims, 12 Drawing Sheets

DISPLAY DEVICE

CROSS REFERENCE TO RELATED APPLICATION

This a continuation of U.S. application Ser. No. 09/588,665, filed Jun. 6, 2000, now U.S. Pat. No. 6,445,371, the subject matter of which is incorporated by reference herein.

BACKGROUND OF THE INVENTION

The present invention relates to a liquid crystal display device and, more particularly, to a technique which is applicable to a TFT (Thin Film Transistor) type of liquid crystal display device made of polysilicon transistors.

An active matrix type liquid crystal display device which has an active element for each pixel and causes the active element to perform a switching operation is one known type of liquid crystal display device. A TFT type of active matrix liquid crystal display module which uses as its active elements thin film transistors each made of an amorphous silicon MOS transistor or a polysilicon MOS transistor is a known type of this active matrix type liquid crystal display device. In the following description, a amorphous silicon MOS transistor will be referred to as an "amorphous-SiTr", a polysilicon MOS transistor will be referred to as a "Poly-SiTr", a TFT type liquid crystal display module using amorphous silicon MOS transistors will be referred to as an "amorphous-SiTr-TFT liquid crystal display module", and a TFT type of liquid crystal display module using polysilicon MOS transistors will be referred to as a "Poly-SiTr-TFT liquid crystal display module".

The amorphous-SiTr-TFT liquid crystal display module is widely used as a display device for personal computers or television sets. However, in an amorphous-SiTr-TFT liquid crystal display module, a driver circuit for driving the liquid crystal needs to be provided at the periphery of the liquid crystal display panel.

In recent years, a TFT type of liquid crystal display module using Poly-SiTr elements has been developed and is now used in liquid crystal projectors, head-mounted (glasses-type) displays and the like. In the liquid crystal display panel of a Poly-SiTr-TFT liquid crystal display module, Poly-SiTr elements are formed so as to be disposed in matrix form on a quartz or glass substrate, as in the case of the liquid crystal display panel of an amorphous-SiTr-TFT liquid crystal display module.

Moreover, since the operating speed of the Poly-SiTr element is faster than that of the amorphous-SiTr element, the liquid crystal panel of the Poly-SiTr-TFT liquid crystal display module can be formed on one substrate together with its peripheral circuits. This is described in, for example, NIKKEI ELECTRONICS, Nikkei-McGraw-Hill, Feb. 28, 1994, pp. 103–109.

SUMMARY OF THE INVENTION

In the existing type of single-crystal Si semiconductor MOS transistor, even with a comparatively simple circuit construction, such as that shown in FIG. 14, it is possible to avoid, at a practical level, the shift of the voltage level of a threshold voltage Vth of each MOS transistor TR1 to TR3. However, under the present circumstances, in a Poly-SiTr element whose channel formation region is made of polycrystalline silicon, multiple grain boundaries arc generally present below its gate. Accordingly, even if transistors each having the same dimensions arc disposed in the vicinity of one substrate, their threshold voltages Vth generally do not coincide to an extent that can be practically approximated. Therefore, in general, in the case of a circuit construction such as that shown in FIG. 14, which uses Poly-SiTr elements, output voltages VOUT1 to VOUT3 of the respective MOS transistors TR1 to TR3 shift to an unallowable extent in practical terms.

If, for example, Poly-SiTr elements are used and a circuit construction such as that shown in FIG. 14 is adopted for the purpose of supplying pixel drive voltages (or grayscale voltages) to the respective pixels of a liquid crystal panel of a Poly-SiTr-TFT liquid crystal display module, there is the problem that linear patterns occur on the display screen of a liquid crystal display panel owing to the shifts of the output voltages VOUT1 to VOUT3 due to the shifts of the threshold voltage (Vth) of the respective Poly-SiTr elements, so that the display quality of the display screen of the liquid crystal display panel is impaired to a remarkable extent.

The present invention has been made to solve the problem of the above-described related art, and an object of the present invention is to provide a technique which is capable of improving the display quality of the display screen of a liquid crystal display element in a liquid crystal display device.

The above and other objects and novel features of the present invention will become apparent from the following description, taken in conjunction with the accompanying drawings.

Representative aspects of the invention disclosed in the present application are as described below in brief.

The present invention provides a liquid crystal display device which comprises plural pixels provided in matrix form, plural video signal lines which apply pixel drive voltages to pixels arrayed along columns or rows of the matrix of the plural pixels, and a drive part which supplies the pixel drive voltages to the plural video signal lines. The drive part includes plural video signal input parts which supply the pixel drive voltages to the respective video signal lines. Each of the video signal input parts includes a first field-effect transistor, a first part which sets a voltage value of a control electrode of the first field-effect transistor to a voltage value obtained by correcting a common pixel drive voltage by a threshold voltage of the first field-effect transistor, a second part which sets the voltage value of the control electrode of the first field-effect transistor to a voltage obtained by adding a video signal voltage to the voltage value corrected by the first part, and a third part which supplies a voltage obtained by adding the video signal voltage to the common pixel drive voltage, to the video signal line as a pixel drive voltage, as well as to the first field-effect transistor, the voltage value of whose control electrode is set by the second part to the voltage obtained by adding the video signal voltage to the voltage value corrected by the first part.

According to the present invention, the drive part has a control part which controls each of the video signal input parts, and the control part transmits a first-mode control signal to each of the video signal input parts and causes each of the video signal input parts to supply a voltage, obtained by adding the video signal voltage to the common pixel drive voltage, to the corresponding one of the video signal lines as the pixel drive voltage, and also transmits a second-mode control signal to each of the video signal input parts and causes each of the video signal input parts to supply a voltage, obtained by subtracting the video signal voltage from the common pixel drive voltage, to the corresponding one of the video signal lines as the pixel drive voltage.

According to the present invention, the first-mode control signal transmitted from the control part has first to fifth control signals, and the first to fifth control signals are transmitted to each of the video signal input parts in the order of from the fifth control signal to the fourth control signal to the third control signal, and in the order of from the first control signal to the second control signal, while the fifth control signal is being transmitted.

According to the present invention, the second-mode control signal transmitted from the control part has first to fifth control signals, and the first to fifth control signals are transmitted to each of the video signal input parts in the order of from the fourth control signal to the first control signal to the second control signal to the fifth control signal to the third control signal.

According to the present invention, the first part includes a second field-effect transistor having a second electrode to which a first reference voltage is to be applied, and a first electrode connected to the control electrode of the first field-effect transistor, a third field-effect transistor having a second electrode connected to the first electrode of the second field-effect transistor and a first electrode connected to the second electrode of the first field-effect transistor, and a fourth field-effect transistor having a second electrode connected to the first electrode of the first field-effect transistor and a first electrode to which the common pixel drive voltage is to be applied. The third part includes a fifth field-effect transistor having a second electrode connected to a second reference voltage and a first electrode connected to the second electrode of the first field-effect transistor, and a sixth-field-effect transistor having a second electrode connected to the first electrode of the first field-effect transistor and a first electrode connected to the corresponding one of the video signal lines. The second field-effect transistor is turned on when the first control signal outputted from the control part is applied to a control electrode of the second field-effect transistor. The third and fourth field-effect transistors are turned on when the second control signal outputted from the control part is applied to control electrodes of the respective third and fourth field-effect transistors. The fifth and sixth field-effect transistors are turned on when the third control signal outputted from the control part is applied to control electrodes of the respective fifth and sixth field-effect transistors.

According to the present invention, the second part includes a seventh field-effect transistor having a second electrode to which a video signal voltage is to be applied, an eighth field-effect transistor having a first electrode to which a third reference voltage is to be applied, and a second electrode connected to a first electrode of the seventh field-effect transistor, and a coupling capacitor connected between the first electrode of the seventh field-effect transistor and the first electrode of the second field-effect transistor. The seventh field-effect transistor is turned on when the fourth control signal outputted from the control part is applied to a control electrode of the seventh field-effect transistor, and the eighth field-effect transistor is turned on when the fifth control signal outputted from the control part-is applied to a control electrode of the eighth field-effect transistor.

According to the present invention, the second part includes plural data input parts provided by the number of bits of display data, and each of the data input parts includes a latch part which stores each bit value of display data, a seventh field-effect transistor having a second electrode connected to the latch part, an eighth field-effect transistor having a first electrode to which a third reference voltage is to be applied, and a second electrode connected to a first electrode of the seventh field-effect transistor, and a coupling capacitor connected between the first electrode of the seventh field-effect transistor and the first electrode of the second field-effect transistor. The seventh field-effect transistor of each of the data input parts is turned on when the fourth control signal outputted from the control part is applied to a control electrode of the seventh field-effect transistor. The eighth field-effect transistor of each of the data input parts is turned on when the fifth control signal outputted from the control part is applied to a control electrode of the eighth field-effect transistor.

According to the present invention, the drive part includes two lines of video signal input parts, and further includes plural selecting parts which alternately supply pixel drive voltages from the two lines of video signal input parts to the corresponding one of the video signal lines.

According to the present invention, in each of the field-effect transistors, a channel formation region below the control electrode is made of polycrystalline silicon. According to the present invention, the plural pixels provided in matrix form, the plural video signal lines and the drive parts are incorporated in a liquid crystal display element.

BRIEF DESCRIPTION OF THE DRAWINGS

Preferred embodiments of the invention will be described in detail with reference to the following figures, wherein.

DESCRIPTION OF THE PREFERRED EMBODIMENTS

Figure 1:
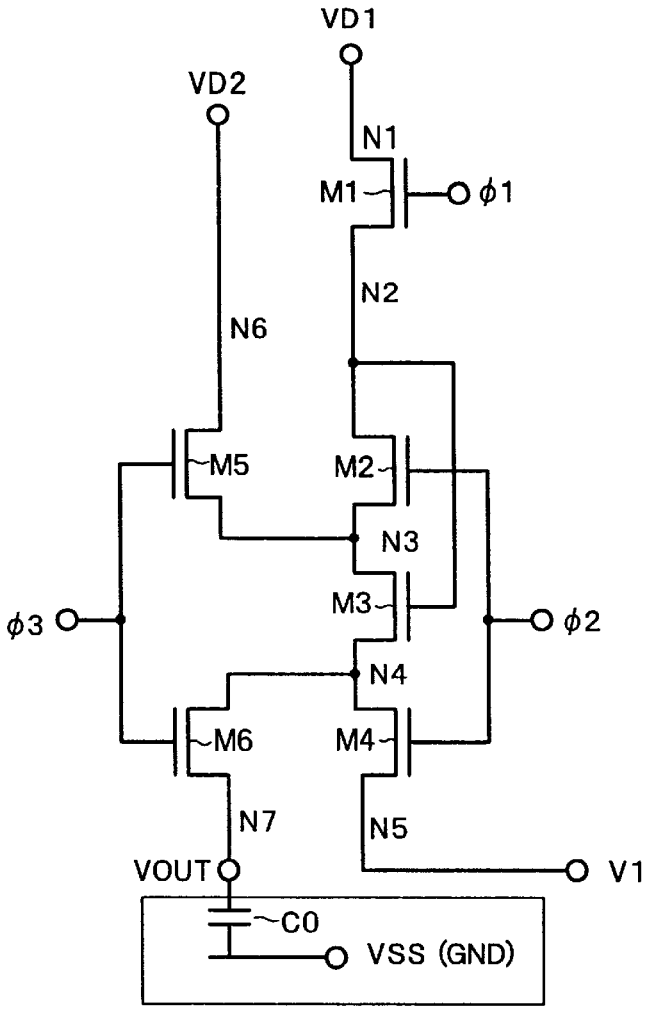
FIG. 1 is a circuit diagram showing the circuit construction of one example of a voltage regenerating circuit to be applied to a Poly-SiTr-TFT liquid crystal display module according to the present invention.

Preferred embodiments of the present invention will be described below with reference to the accompanying drawings. Incidentally, throughout all drawings that illustrate the preferred embodiments of the present invention, parts having identical functions are denoted by identical reference numerals, and the repetitive description of such identical parts is omitted.

Figure 2:
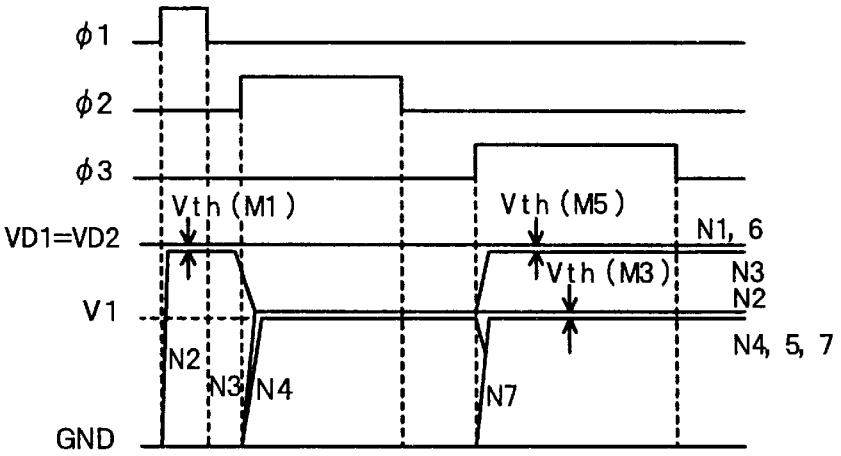
FIG. 2 is a waveform diagram showing some examples of external pulse waveforms $\phi$1 to $\phi$3 to be inputted to the voltage regenerating circuit shown in FIG. 1, as well as voltage waveforms which appear at individual nodes when each of the external pulse waveforms $\phi$1 to $\phi$3 is inputted.

FIG. 1 is a circuit diagram showing the circuit construction of one example of a voltage regenerating circuit to be applied to a Poly-SiTr-TFT liquid crystal display module according to the present invention. FIG. 2 is a waveform diagram showing some examples of external pulse waveforms ϕ1 to ϕ3 to be inputted to the voltage regenerating circuit shown in FIG. 1, as well as voltage waveforms which appear at individual nodes when each of the external pulse waveforms ϕ1 to ϕ3 is inputted.

The voltage regenerating circuit shown in FIG. 1 is made of only NMOS transistors, and in FIG. 1, symbols M1 to M6 denote MOS transistors, and symbol CO denotes a load capacitor. Symbols N1 to N7 denote nodes of the voltage regenerating circuit, and the node N7 is an output terminal VOUT of the voltage regenerating circuit. For the sake of simplicity, the nodes other than the nodes N1, N5 and N6 to which bias voltages VD1, V1 and VD2 are respectively coupled are assumed to be in their initial states (GND). In addition, the bias voltages VD1 and VD2 are high voltages, and are assumed to be VD1=VD2 for the sake of simplicity. The voltage V1 is a voltage to be outputted, and it is assumed here that the voltage V1 satisfies the following expression (1).

$$V1<VD1-Vth(M3)-Vth(M2 \text{ or } M5) \quad (1)$$

where Vth(Mn) represents the threshold voltage of a MOS transistor Mn.

The operation of the voltage regenerating circuit shown in FIG. 1 under the above-described conditions will be described below.

1) When the external pulse ϕ1 changes from its low level (GND; hereinafter referred to simply as the L level) to its high level (PVH1; hereinafter referred to simply as the H level), the MOS transistor M1 is turned on. Incidentally, the H level (pvH1) needs to satisfy the following expression (2).

$$PVH1>V1+Vth(M4 \text{ or } M6)+Vth(M3)+Vth(M2 \text{ or } M5) \quad (2)$$

If the H level is assumed to be PVH1=VD1 for the sake of simplicity, when the MOS transistor M1 is turned on, the voltage of the node N2 changes from GND to VD1−Vth (M1). At this time, the external pulse ϕ1 again goes to the L level and the MOS transistor M1 is turned off. Strictly, at this time, a voltage shift of approximately AV occurs owing to the coupling capacitor C12 between the gate of the MOS transistor M1 and the node N2, but the voltage shift can be restricted to a practically negligible value by increasing the capacitance C2 to a sufficient extent. Accordingly, the following discussion will not refer to such a voltage shift.

$$\Delta V @C12—(VD1-Vth(M1)/C2 \quad (3)$$

In Expression (3), C2 represents the total capacity of the node N2.

2) When the external pulse ϕ2 changes from its L level (GND) to its high level (PVH2), the MOS transistor M2 and the MOS transistor M4 are turned on. Incidentally, the H level (PVH2) needs to satisfy the following expression (4).

$$PVH2>V1+Vth(M4 \text{ or } M6)+Vth(M3)+Vth(M2 \text{ or } M5) \quad (4)$$

At this time, the MOS transistor M3 is diode-connected with the voltage of the node N2 being applied to the MOS transistor M3 as a gate voltage, and therefore, when the voltage of the node N2 reaches V1+Vth(M3), the MOS transistor M3 is pinched off and the current stops. At this time, the external pulse ϕ2 again goes to the L level, and the MOS transistor M2 and the MOS transistor M4 are turned off. Accordingly, the voltage of the node N2 which is the gate voltage of the MOS transistor M3 is held at V1−Vth (M3).

3) When the external pulse ϕ3 changes from its L level (GND) to its H level (PVH3), the MOS transistor M5 and the MOS transistor M6 are turned on. Incidentally, the H level (PVH3) needs to satisfy the following expression (5).

$$PVH3>V1+Vth(M4 \text{ or } M6)+Vth(M3)+Vth(M2 \text{ or } M5) \quad (5)$$

Thus, a voltage (current) output circuit system, in which the node N6, the MOS transistor M5, the node N3, the MOS transistor M3, the node N4, the MOS transistor M6 and the output terminal VOUT are connected in the order of N6 ® M5 ® N3 ® M3 ® N4® M6 ® VOUT, is turned on, and a current is supplied from the node N6 to an output terminal VOUT.

At this time, since a load capacitor C0 of voltage V0 (V0<V1) is connected to the output side of the output terminal VOUT, when the voltage of the load capacitor C0 reaches V1, the MOS transistor M3 is again pinched off and the supply of the current stops. In other words, the voltage of the load capacitor C0 can be made V1 irrespective of the value of the load capacitor C0 and the threshold voltage (Vth(M3)) of the MOS transistor M3.

Incidentally, although the voltage regenerating circuit using only NMOS transistors has been described above with reference to FIG. 1, the voltage regenerating circuit shown in FIG. 1 may have a circuit construction using only PMOS transistors, and may also have a CMOS construction. For example, the voltage regenerating circuit may have a CMOS construction in which each of the MOS transistors M2 and M5 is a PMOS transistor and each of the MOS transistor M4 and M6 is an NMOS transistor.

Figure 3:
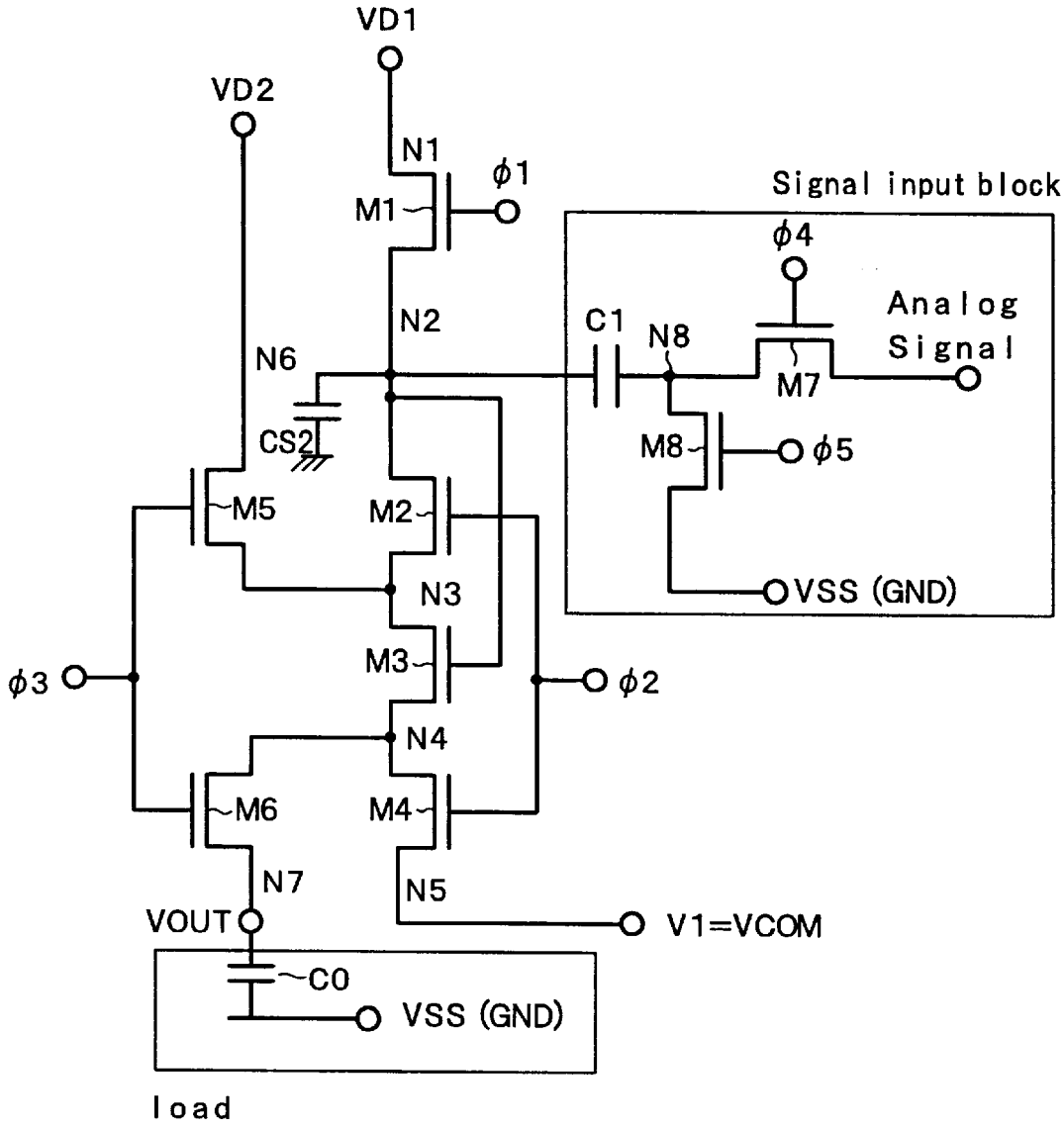
FIG. 3 is a circuit diagram showing the circuit construction of one example of an applied circuit to which the voltage regenerating circuit shown in FIG. 1 is applied.
Figure 4:
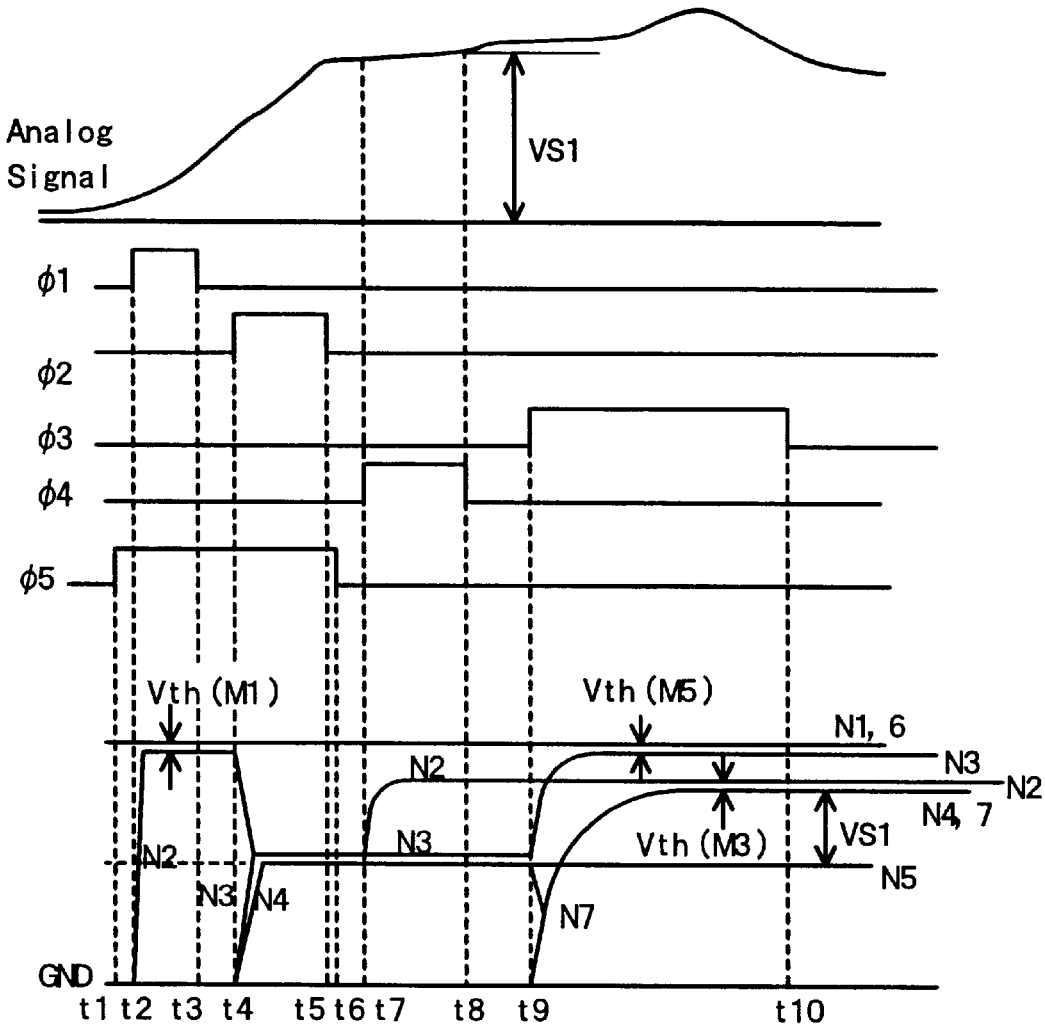
FIG. 4 is a waveform diagram showing some examples of external pulse waveforms $\phi$1 to $\phi$5 to be inputted to the applied circuit shown in FIG. 3, as well as voltage waveforms which appear at individual nodes when each of the external pulse waveforms $\phi$1 to $\phi$5 is inputted.

FIG. 3 is a circuit diagram showing the circuit construction of one example of a circuit to which the voltage regenerating circuit shown in FIG. 1 is applied. FIG. 4 is a wave form diagram showing some examples of external pulse waveforms $\phi 1$ to $\phi 5$ to be inputted to the applied circuit shown in FIG. 3 as well as voltage waveforms which appear at individual nodes when each of the external pulse waveforms $\phi 1$ to $\phi 5$ is inputted.

In the circuit shown in FIG. 3, a signal input part is added to the voltage regenerating circuit shown in FIG. 1, and the signal input part includes a capacitor C1 to be capacitively coupled to the node N2, and two MOS analog switch transistors M7 and M8 to be controlled by the external pulses $\phi 4$ and $\phi 5$. An analog signal voltage supplied from outside is inputted to the drain of the MOS analog switch transistor M7, and a reference bias voltage VSS (=GND) is applied to the source of the MOS analog switch transistor MS. Incidentally, it is assumed that V1 is equal to VCOM.

The operation of the applied circuit shown in FIG. 3 will be described below with reference to FIG. 4.

1) Since the operation of the applied circuit is identical to that of the voltage regenerating circuit shown in FIG. 1 until time t7 of FIG. 4, the voltage of the node N2 becomes VCOM+Vth(M3) owing to an operation which is performed by the applied circuit until the time t7. The reason why the external pulse $\phi 5$ is set to the H level by the time t7 is to set a node N8 to VSS (=GND) irrespective of the pulsations of the external pulses $\phi 1$ and $\phi 2$.

2) During the interval from the time t7 until time tS for which the external pulse $\phi 4$ is at its H level, the analog signal voltage supplied during this interval is read into the node N8, and the voltage of the node N2 changes toward the analog signal voltage in accordance with a time constant determined by the capacitor C1 and a capacitor CS2, as well as the ON resistance of the MOS transistor M7. The voltage level of the node N2 after the time t8 is determined by the voltage inputted by this time t8. Incidentally, the capacitor CS2 is a parasitic capacitor of the node N2 and is a capacitor other than the capacitor C1. Letting VS1 be the voltage shift of the node N2 from the time t7 until the time t8, the voltage of the node N2 after the time t8 is VCOM+Vth(M3)+VS1.

3) When the external pulse $\phi 3$ goes to the H level at the time t9, the MOS transistors M5 and M6 are turned on and the voltage (current) output circuit system is turned on. At this time, a current is supplied from the node N6 to the output terminal VOUT so that the load capacitor C0 is charged to a voltage which causes the MOS transistor M3 to pinch off (VCOM+VS1). Specifically, the analog signal voltage VS1 read into the MOS transistor M7 can be added to a certain reference voltage VCOM without a voltage shift nor the influence of the threshold-voltage Vth(M3) of the MOS transistor M3. In addition, in the applied circuit shown in FIG. 3, by changing the input timing of the external pulses, it is easy to subtract the analog signal voltage VS1 from the certain reference voltage VCOM.

The operation of subtracting the analog signal voltage VS1 from the certain reference voltage VCOM in the applied circuit shown in FIG. 3 will be described below with reference to FIG. 5.

Figure 5:
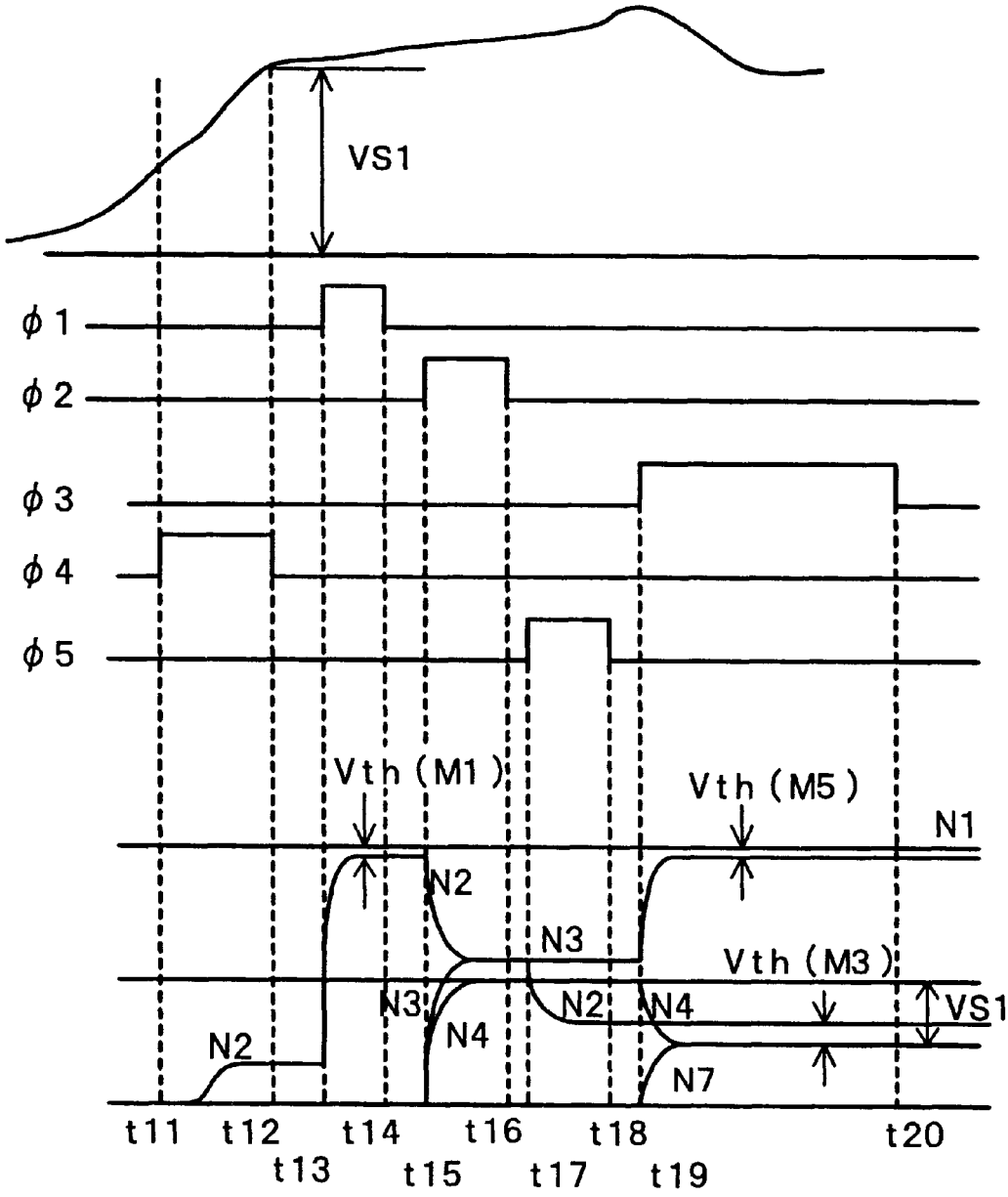
FIG. 5 is a waveform diagram showing other examples of the external pulse waveforms $\phi$1 to $\phi$5 to be inputted to the applied circuit shown in FIG. 3, as well as voltage waveforms which appear at individual nodes when each of the external pulse waveforms $\phi$1 to $\phi$5 is inputted.

FIG. 5 is a waveform diagram showing other examples of the external pulse waveforms $\phi 1$ to $\phi 5$ to be inputted to the applied circuit shown in FIG. 3 as well as voltage waveforms which appear at, individual nodes when each of the external pulse waveforms $\phi 1$ to $\phi 5$ is inputted.

1) First of all, during the interval from time t11 until time t12, the external pulse $\phi 4$ is set to the H level. At this time, as in the case of FIG. 4, the node N8 is set to an analog signal voltage VS1'. Incidentally, the analog signal voltage VS1' is a voltage which satisfies the following expression (6).

$$VS1=(VS1\times C1)/(C1+CS2) \quad (6)$$

2) After that, during the interval from the time t12 until time t16, a series of operations to set the external pulse $\phi 1$ to the H level and then the external pulse $\phi 2$ to the H level is performed. Thus, the voltage of the node N2 immediately after the time t16 becomes VCOM+Vth(M3) under the condition that the node N8 is at VS1.

3) At time t17, when the external pulse $\phi 5$ goes to the H level, the voltage of the node N8 changes to the level VSS (=GND), so that the voltage of the node N2 becomes VCOM+Vth(M3)−VS1.

4) At time t19, when the external pulse $\phi 3$ goes to the H level, the MOS transistors M5 and M7 are turned on and the voltage (current) output circuit system is turned on. At this time, a current is supplied from the node N6 to the output terminal VOUT so that the load capacitor C0 is charged to a voltage which causes the MOS transistor M3 to pinch off (VCOM−VS1).

Specifically, the analog signal voltage VS1 read into the MOS transistor M7 can be subtracted from the certain reference voltage VCOM without a voltage shift nor the influence of the threshold voltage Vth(M3) of the MOS transistor M3.

The applied circuit shown in FIG. 3 is particularly useful as the built-in driver circuit of the display panel of a liquid crystal display module which requires a pixel drive voltage of positive or negative polarity relative to a common voltage to be applied to a common electrode (a common pixel drive voltage in the present invention). For example, in the applied circuit shown in FIG. 3, if the certain reference voltage VCOM is used as the common voltage to be applied to the common electrode, a voltage of positive or negative polarity can easily be supplied to each pixel electrode by executing the pulse driving shown in FIGS. 4 and 5.

Figure 6:
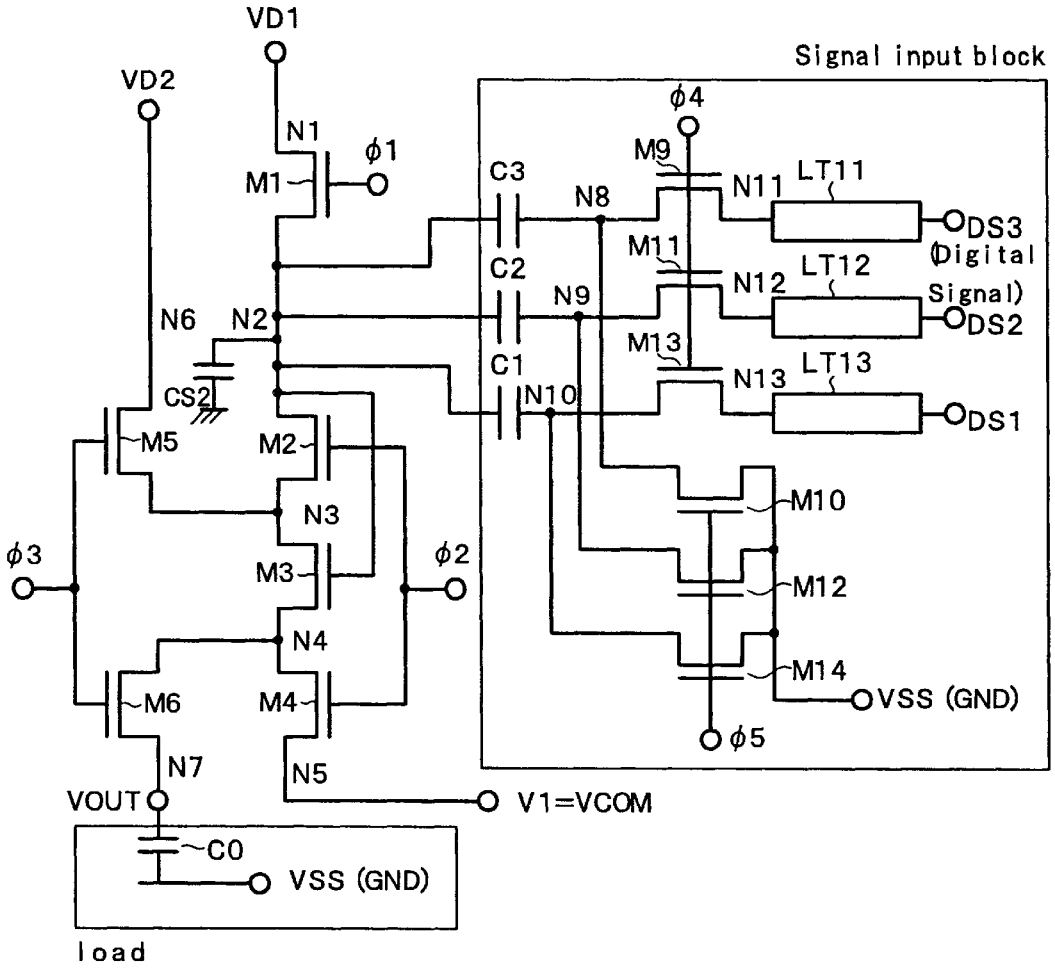
FIG. 6 is a circuit diagram showing the circuit construction of another example of an applied circuit to which the voltage regenerating circuit shown in FIG. 1 is applied.
Figure 7:
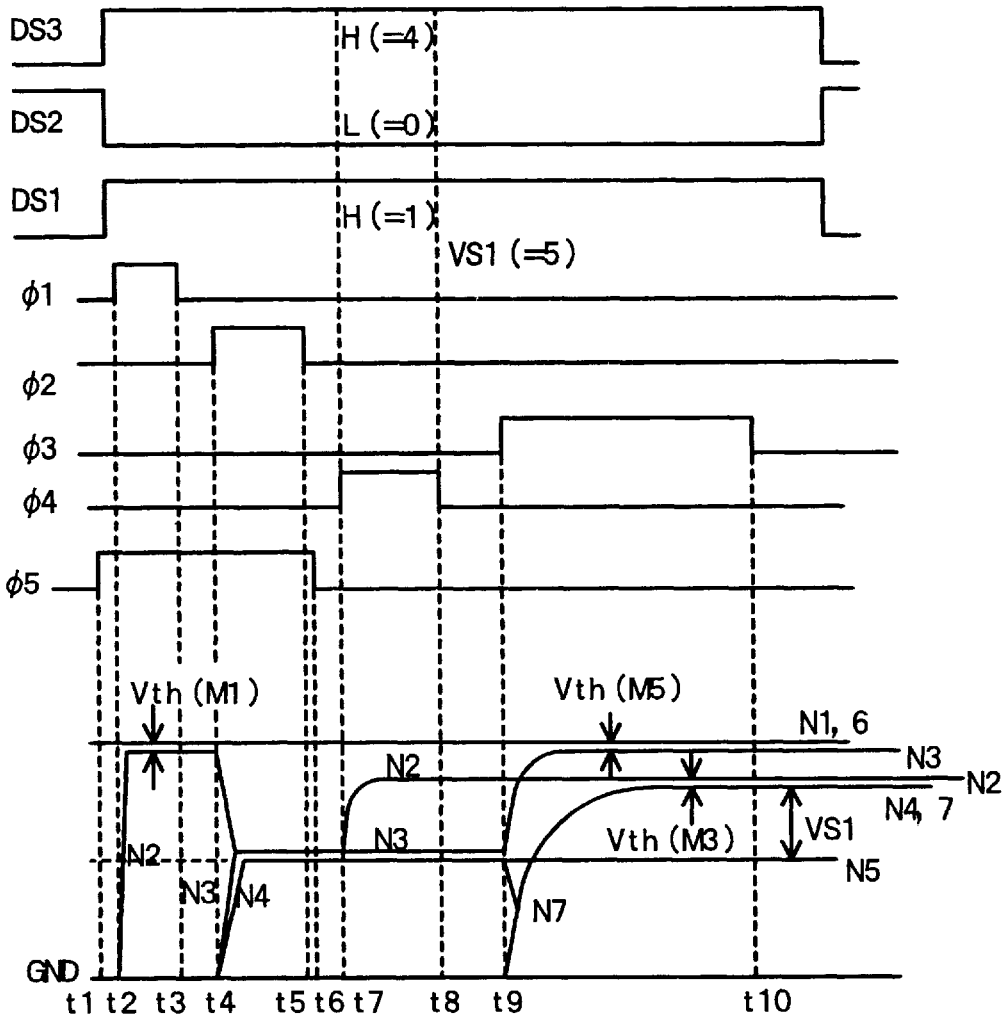
FIG. 7 is a waveform diagram showing some examples of the external pulse waveforms $\phi$1 to $\phi$5 to be inputted to the applied circuit shown in FIG. 6, as well as voltage waveforms which appear at individual nodes when each of the external pulse waveforms $\phi$1 to $\phi$5 is inputted.

FIG. 6 is a circuit diagram showing the circuit construction of another example of an applied circuit to which the voltage regenerating circuit shown in FIG. 1 is applied. FIG. 7 is a showing some examples of the external pulse waveforms $\phi 1$ to $\phi 5$ to be inputted to the applied circuit shown in FIG. 6, as well as voltage waveforms which appear at individual nodes when each of the external pulse waveforms $\phi 1$ to $\phi 5$ is inputted.

The circuit shown in FIG. 6 is a modification of the circuit shown in FIG. 3 in which its input signal is a 3-bit digital signal. In the circuit shown in FIG. 6, the number of coupling capacitors C1 to C3 that is equivalent to the number of bits (in FIG. 6, 3 bits) are connected to the node N2. A MOS analog switch transistor M9 and a MOS analog switch transistor M10 are connected to the node N8 which is connected to the node N2 via the coupling capacitor C3. The signal voltage of an input digital signal DS3 supplied from a data latch part LT11 is inputted to the drain of the MOS analog switch transistor M9, and the reference bias voltage VSS (=GNU) is applied to the source of the MOS analog switch transistor M10.

Similarly, a MOS analog switch transistor M11 and a MOS analog switch transistor M12 are connected to the node N9 which is connected to the node N2 via the coupling capacitor C2. The signal voltage of an input digital signal DS2 supplied from a data latch part LT12 is inputted to the drain of the MOS analog switch transistor M11, and the reference bias voltage VSS (=GND) is applied to the source of the MOS analog switch transistor M12. Also, a MOS analog switch transistor M13 and a MOS analog switch transistor M14 are connected to a node N10 which is connected to the node N2 via the coupling capacitor C1. The signal voltage of an input digital signal DS1 supplied from a data latch part LT13 is inputted to the drain of the MOS analog switch transistor M13, and the reference bias voltage VSS (=GND) is applied to the source of the MOS analog switch transistor M14.

The input digital signals DS1 to DS3 arc latched by the respective data latch parts LT1 to LT3, and are outputted to the respective nodes N11 to N13 at the desired timings. The digital signal voltage outputted to each of the nodes N11 to N13 is converted to an analog signal voltages, and the analog signal voltage is outputted to the node N2 and the applied circuit is operated in a manner similar to that described previously in connection with FIG. 4. Thus, the analog signal voltage VS1 which corresponds to the 3-bit digital signal voltage outputted from the data latch parts LT1 to LT3 can be added to the certain reference voltage VCOM without a voltage shift nor the influence of the threshold voltage Vth(M3) of the MOS transistor M3. Since the operation performed by the shown circuit in this case is identical to that described previously in connection with FIG. 4, the detailed description thereof is omitted.

The digital/analog conversion may be effected by a construction in which the respective signal voltages to be outputted to the output nodes N11 to N13 are different voltages VA, 2VA and 4VA (in the case of, for example, 3 bits) and the coupling capacitors C1 to C3 have the same capacitance value, or by a construction in which the respective signal voltages to be outputted to the output nodes N11 to N13 have a fixed value and the values of the respective coupling capacitors C1 to C3 are CA, 2CA and 4CA. In this case, the coupling capacitors C1 to C3 may be set to capacitance levels at which the voltage effect of the capacitor CS2 is practically negligible.

Figure 8:
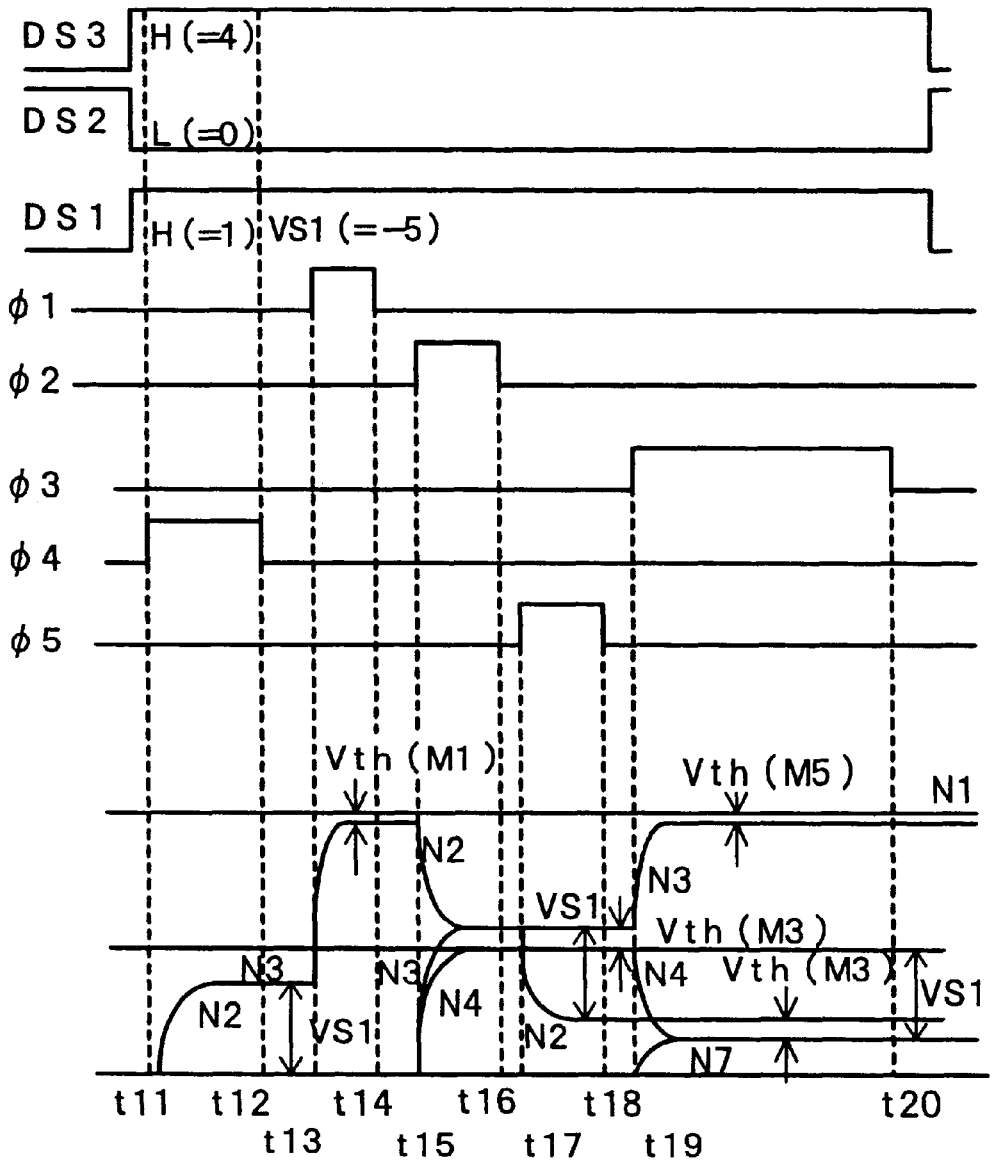
FIG. 8 is a waveform diagram showing other examples of the external pulse waveforms $\phi$1 to $\phi$5 to be inputted to the applied circuit shown in FIG. 6, as well as voltage waveforms which appear at the individual nodes when each of the external pulse waveforms $\phi$1 to $\phi$5 is inputted.

FIG. 8 is a waveform diagram showing some examples of the external pulse waveforms $\phi$1 to $\phi$5 to be inputted to the applied circuit shown in FIG. 6, as well as voltage waveforms which appear at the individual nodes when each of the external pulse waveforms $\phi$1 to $\phi$5 is inputted. FIG. 8 shows the timing to input each of the external pulse waveforms $\phi$1 to $\phi$5 in a case where the analog signal voltage VS1 is subtracted from the certain reference voltage VCOM in the circuit shown in FIG. 6.

The circuit shown in FIG. 6 is operated at the timing shown in FIG. 5 so that the analog signal voltage VS1 which corresponds to the 3-bit digital signal voltage outputted from the data latch parts LT1 to LT3 can be subtracted from the certain reference voltage VCOM without a voltage shift nor the influence of the threshold voltage Vth(M3) of the MOS transistor M3. Since the operation performed by the circuit in this case is identical to that described previously in connection with FIG. 5, the detailed description thereof is omitted. Incidentally, for the sake of simplicity, the above description ignores the voltage shifts of floating nodes due to the on/off states of the gates of the MOS transistors, but it goes without saying that such floating nodes must be taken into account in practical applications.

In addition, a device such as a normal semiconductor having a deep WELL or SUB structure has a large substrate effect constant based on its source voltage shift, and the method of shifting a shift gate voltage after the setting of the threshold voltage Vth as in the case of the aforementioned applied circuit provides an excessively large quantity of shift of the threshold voltage Vth due to a substrate effect, and there is a possibility that the cancellation of the threshold voltage Vth which is an aim of the present invention may become insufficient. However, such method can be practically used in TFT or SO1 thin transistors made of Poly-SiTr because their substrate effects are small.

Figure 9:
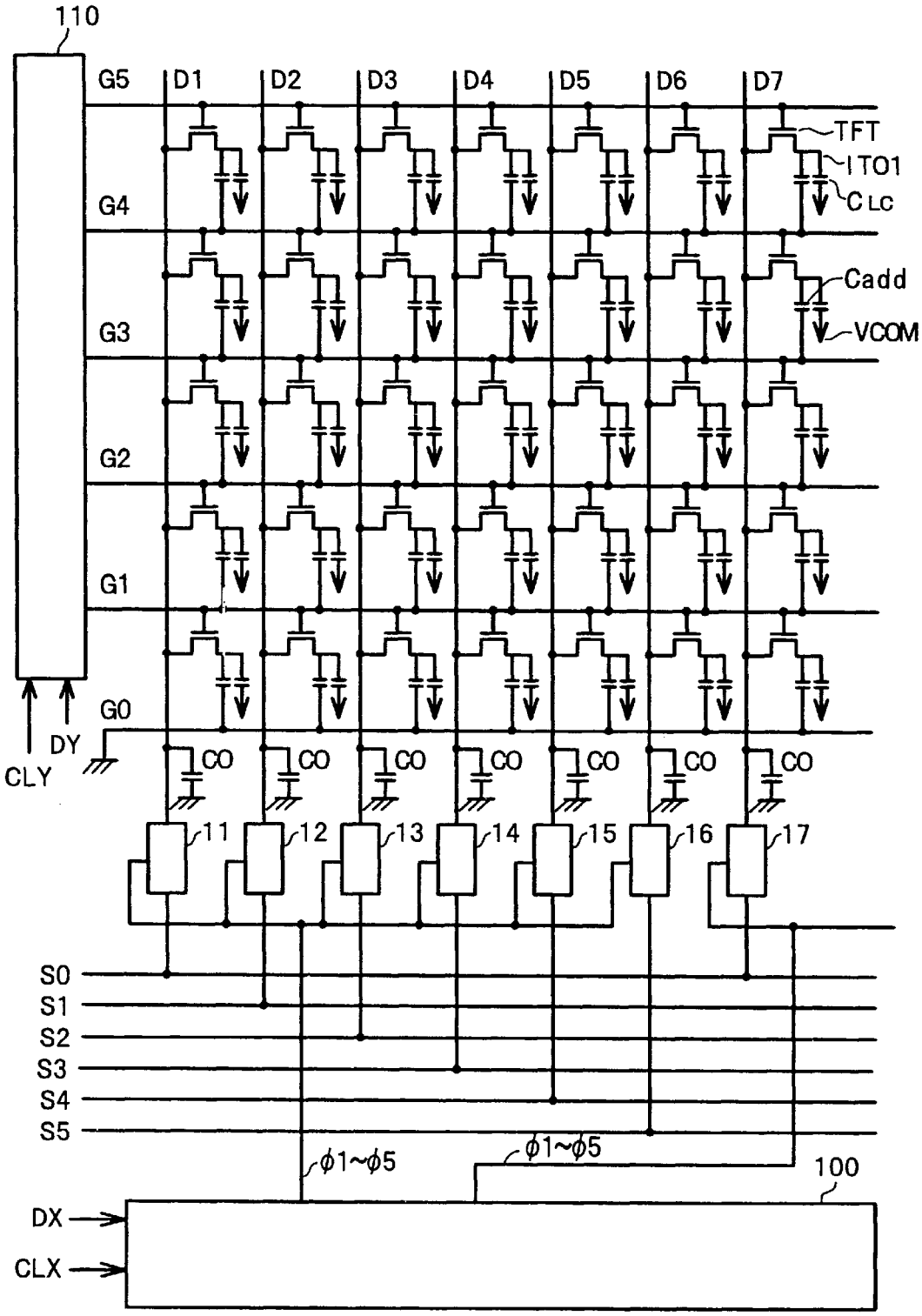
FIG. 9 is an equivalent circuit diagram of the liquid crystal display panel of a Poly-SiTr-TFT liquid crystal display module according to a first embodiment of the present invention.

FIG. 9 is an equivalent circuit diagram of the display panel of a Poly-SiTr-TFT liquid crystal display module according to a first embodiment of the present invention. In FIG. 9, the circuit diagram is depicted in accordance with the actual geometrical layout of the display panel. The liquid crystal display panel according to the first embodiment (a liquid crystal display element according to the present invention) includes m-number of scanning signal lines G and n-number of video signal lines D. FIG. 9 shows six scanning signal lines G and seven video signal lines D.

The liquid crystal display panel of the first embodiment has pixels disposed in a matrix arrangement, and each of the pixels is disposed in an intersection area of two adjacent scanning signal lines (gate signal lines or horizontal signal lines) G and two adjacent video signal lines (drain signal lines or vertical signal lines) D (an area surrounded by four signal lines). Each of the pixels has, for example, a thin film transistor TFT made of Poly-SiTr, and the drains of the respective thin film transistors TFT of the pixels disposed along each column of the matrix are connected to the adjacent one of the video signal lines D, and the sources of the respective thin film transistors TFT of the pixels disposed in matrix are connected to pixel electrodes ITO1.

Incidentally, the source and the drain of each of the transistors are originally determined by the bias polarity therebetween, and during the operation of the module according to the first embodiment, the polarity is inverted and the drain and the source are switched therebetween. However, in the present specification, for the sake of convenience of description, one of the electrodes of each of the transistors is fixed as a drain and the other is fixed as a source. The video signal lines D are connected to the corresponding video signal lines SO to S5 via video signal input circuits 11 to 17.

Each of the video signal input circuits 11 to 17 is provided in the form of the applied circuit shown in FIG. 4, and the video signal input circuits 11 to 17 are divided into groups each including six video signal input circuits. The external pulses $\phi$1 to $\phi$5 are, at the same timing, inputted to the respective video signal input circuits 11 to 16 of each of the groups from a control circuit part 100. The gates of The respective thin film transistors TFT of the pixels disposed along each row of the matrix are connected to the adjacent one of the scanning signal lines G, and the scanning signal lines G are connected to a vertical scanning circuit 110. Each of the thin film transistors TFT becomes conductive when a positive bias voltage is applied to the gate, and non-conductive when a negative bias voltage is applied to the gate.

Since a liquid crystal layer is provided between the pixel electrodes IT01 and common electrodes, a liquid crystal capacitor $C_{LC}$ is equivalently connected to each of the pixel electrodes ITO1. In addition, a hold capacitor Cadd is connected between the scanning signal line G located at each stage and the pixel electrode ITO1 located at the next stage. Incidentally, the video signal input circuits 11 to 17, the control circuit part 100, a vertical scanning shift register VSR and the vertical scanning circuit 110 are incorporated in the liquid crystal display panel, and are made of Poly-SiTr similarly to the thin film transistors TFT and are formed on the same substrate.

The operation of the liquid crystal display panel according to the first embodiment will be described below in brief.

The vertical scanning circuit 110 shown in FIG. 9 sequentially selects a particular scanning signal line G from the scanning signal lines G in accordance with a start pulse DY and a vertical driving clock signal CLY, and outputs a positive bias voltage to the selected scanning signal line G. Thus, thin film transistors TFT each having a gate connected to the selected scanning signal line G are turned on.

The control circuit part 100 outputs the external pulses $\phi$1 to $\phi$5 to each of the video signal input circuits 11 to 16 of each of the groups in accordance with a start pulse DX and a horizontal driving clock signal CLX, whereby six divided video signals from video signal lines SO to S5 are outputted to the corresponding six video signal lines D by the respective video signal input circuits 11 to 16 which constitute each of the groups. Accordingly, the input video signals (the voltages of the video signals) are respectively written to pixels which correspond to the thin film transistors TFT each having a gate connected to the selected scanning signal line G, whereby an image is displayed on the liquid crystal display panel.

Figure 10:
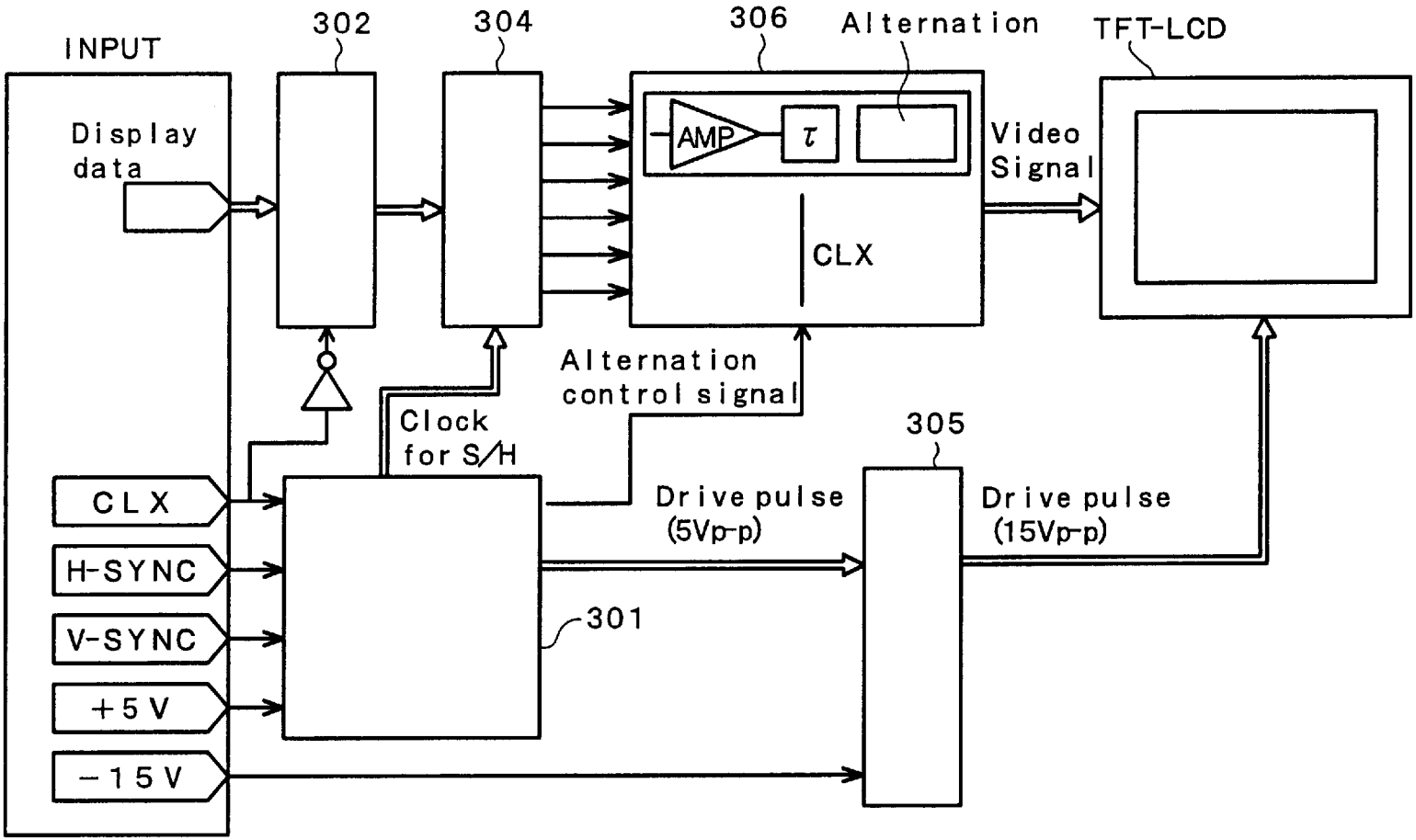
FIG. 10 is a circuit diagram schematically showing the circuit construction of a peripheral circuit of the Poly-SiTr-TFT liquid crystal display module according to the first embodiment of the present invention.

FIG. 10 is a block diagram schematically showing the circuit construction of a peripheral circuit of the Poly-SiTr-TFT liquid crystal display module according to the first embodiment. In FIG. 10, symbol TFT-LCD denotes a liquid crystal display panel, and reference numeral 301 denotes a control IC circuit, reference numeral 302 denotes a digital/analog (D/A) converter, reference numeral 304 denotes a sample-and-hold circuit, reference numeral 305 denotes a driver IC circuit, and reference numeral 306 denotes a signal processing circuit. One kind of display data selected from among display data R (red), G (green) and B (blue) which are transmitted from a body side is converted to an analog video signal by the D/A converter 302. Incidentally, in the case where a video signal is supplied from the body side, there is no need for the D/A converter 302.

In the liquid crystal display panel shown in FIG. 9, since the video signal lines D are driven (scanned) in six divided phases, it is necessary to divide a video signal into six phases. For this reason, the video signal outputted from the D/A converter 302 is divided into six phases by the sample-and-hold circuit 304 on the basis of a sample-and-hold (S/H) clock synchronized with the horizontal driving clock signal CLX. The thus-obtained video signals divided in six phases are timing-adjusted to the same phase, and are outputted from the sample-and-hold circuit 304. Then, the video signals divided in six phases are subjected to amplification processing, $\theta$ processing and alternation processing in the signal processing circuit 306, and are supplied to the video signals S1 to S6 of the liquid crystal display panel TFT-LCD. The y processing is signal processing for correcting the gamma characteristic of the liquid crystal layer, and the alternation processing is signal processing for preventing a DC voltage from being applied to the liquid crystal layer. Incidentally, it is also possible to adopt a circuit construction in which the order of the sample-and-hold circuit 304 and the signal processing circuit 306 is reversed.

The liquid crystal display panel shown in FIG. 9 may also be a color liquid crystal display panel capable of displaying a multiple-color image. In this case, display data R, G and B are respectively converted into video signals in the D/A converter 302, and each of the video signals is divided into six phases in the sample-and-hold circuit 304 and the obtained video signals divided in six phases are supplied to the video signals S1 to S6 of the liquid crystal display panel TFT-LCD. However, in the color liquid crystal display panel capable of displaying a multiple-color image, the liquid crystal display panel shown in FIG. 9 needs to have thin film transistors TFT for R, G and B, video signal lines D for R, G and B, and color filters for R, G and B, and video signals R, G and B are respectively supplied to the respective video signal lines D.

The control IC circuit 301 made of one semiconductor integrated circuit LSI generates the horizontal driving clock signal CLX, the vertical driving clock signal CLY and the like on the-basis of a horizontal synchronizing signal H-SYNC, a vertical synchronizing signal V-SYNC and a clock pulse CLK from the body side. The driver IC circuit 305 amplifies each of the horizontal driving clock signal CLX, the vertical driving clock signal CLY and the like to the voltage required to operate the liquid crystal display panel TFT-LCD.

In general, if the same voltage (DC voltage) is applied to a liquid crystal layer for a long time, the inclination of the liquid crystal layer is fixed, so that an after-image phenomenon is caused to reduce the life of the liquid crystal layer. To prevent this problem, in the liquid crystal display device, a drive voltage to be applied to each pixel electrode IT01 is changed between its positive voltage side and its negative voltage side at intervals of a constant time period on the basis of a voltage to be applied to the common electrodes (this method is generally called alternation).

An alternation driving method for the Poly-SiTr-TFT liquid crystal display module according to the first embodiment will be described below.

As a driving method for applying AC voltage to a liquid crystal layer, a common symmetry method and a common inversion method are known. In the Poly-SiTr-TFT liquid crystal display module according to the first embodiment, it is possible to cope with either of the methods by changing the timing of each of the external pulses $\phi$1 to $\phi$5 to be supplied from the control circuit part 100, to the timing, shown in FIG. 4, of a first-mode pulse signal or to the timing, shown in FIG. 5, of a second-mode pulse signal. For example, even in the case of adopting an alternation driving method of applying video signals of positive polarity to the odd lines of odd frames and video signals of negative polarity to the odd lines of even frames, and further applying video signals of negative polarity to the odd lines of even frames and video signals of positive polarity to the even lines of even frames, it is possible to easily cope with such alternation driving method by supplying the external pulses $\phi$1 to $\phi$5 of the timing shown in FIG. 4 or the external pulses $\phi$1 to $\phi$5 of the timing shown in FIG. 5 from the control circuit part 100 to each of the video signal input circuits 11 to 17 during each scanning line period.

One example of the above-described common symmetry method is known as a dot inversion method. In the dot inversion method, for example, in the case of the odd lines of each odd frame, grayscale voltages of negative polarity are applied to the odd-numbered ones of the video signal lines D, while grayscale voltages of positive polarity are applied to the even-numbered ones of the video signal lines D. Furthermore, in the case of the even lines of each odd frame, grayscale voltages of positive polarity are applied to the odd-numbered ones of the video signal lines D, while grayscale voltages of negative polarity are applied to the even-numbered ones of the video signal lines D. In addition, the polarity of each of the lines is inverted from frame to frame, and in the case of the odd lines of each even frame, grayscale voltages of positive polarity arc applied to the odd-numbered ones of the video signal lines D, while grayscale voltages of negative polarity are applied to the even-numbered ones of the video signal lines D. In addition, in the case of the even lines of each even frame, grayscale voltages of negative polarity are applied to the odd-numbered ones of the video signal lines D, while grayscale voltages of positive polarity are applied to the even-numbered ones of the video signal lines D.

Figure 11:
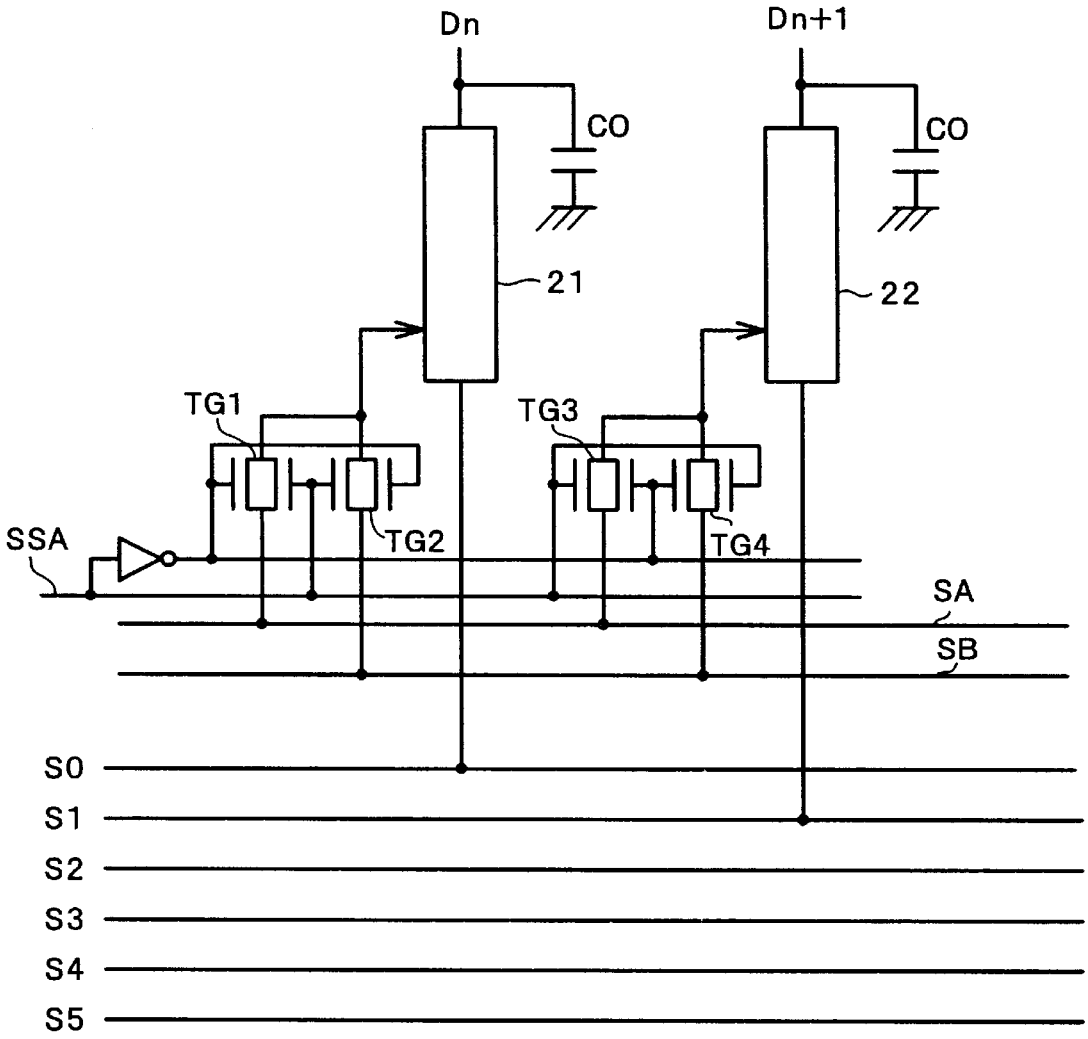
FIG. 11 is a circuit diagram showing the essential portion of one example of a construction for driving the Poly-SiTr-TFT liquid crystal display module according to the first embodiment of the present invention by means of a dot inversion method.

If the above-described dot inversion method is to be adopted in the Poly-SiTr-TFT liquid crystal display module according to the first embodiment, as shown in FIG. 11 by way of example, the timing of each of the external pulses ϕ1 to ϕ5 to be supplied to a video signal input circuit 21 provided on a video signal line Dn is changed to the timing shown in FIG. 4 by way of example, and the timing of each of the external pulses ϕ1 to ϕ5 to be supplied to a video signal input circuit 22 provided on a video signal line Dn+1 adjacent to the video signal line Dn is changed to the timing shown in FIG. 5 by way of example. Each of the external pulses ϕ1 to ϕ5 is switched between these timings from line to line and from frame to frame.

In FIG. 11, reference numerals TG1 to TG4 denote transfer gate circuits, symbol SA denotes a signal line to which to supply each of the external pulses ϕ1 to ϕ5 of the timing shown in FIG. 4, and symbol SB denotes a signal line to which to supply each of the external pulses ϕ1 to ϕ5 of the timing shown in FIG. 5. Symbol SSA denotes a signal line to which to supply a gate switching signal. The gate switching signal SSA is switched between its H and L levels from line to line and from frame to frame, whereby the timing of each of the external pulses ϕ1 to ϕ5 to be supplied to the video signal input circuits 21 and 22 provided on the respective adjacent video signal lines Dn and Dn+1 is switched from line to line and from frame to frame. Moreover, if the above-described dot inversion method is to be adopted in the Poly-SiTr-TFT liquid crystal display module according to the first embodiment, a construction of the type shown in FIG. 12 may also be adopted.

Figure 12:
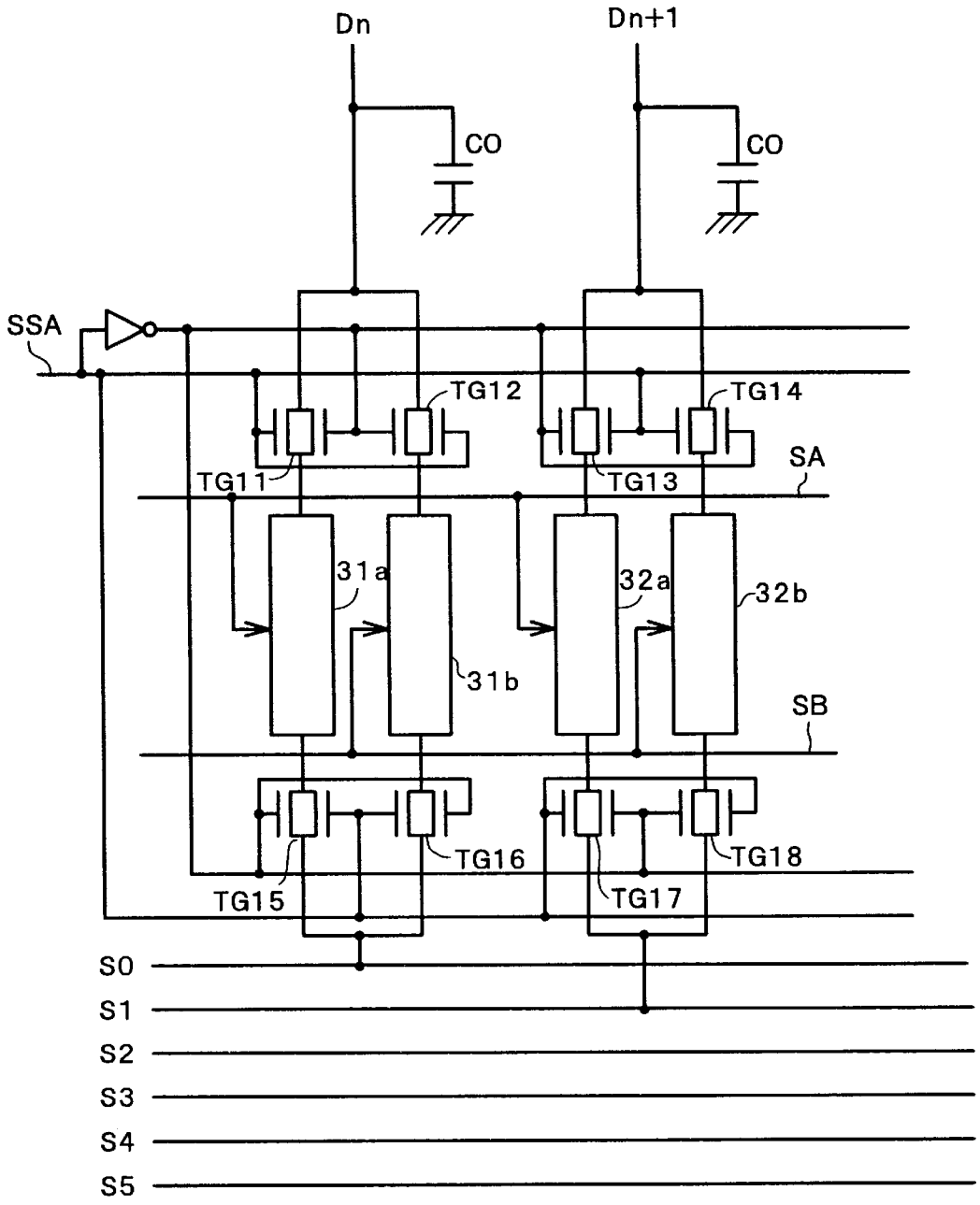
FIG. 12 is a circuit diagram showing the essential portion of another example of the construction for driving the Poly-SiTr-TFT liquid crystal display module according to the first embodiment of the present invention by means of a dot inversion method.

In the construction shown in FIG. 12, two lines of video signal input circuits 31*a* and 31*b*; 32*a* and 32*b* are provided for each video signal, and the timing of each of the external pulses ϕ1 to ϕ5 to be supplied to one of the two lines of video signal input circuits and the timing of each of the external pulses ϕ1 to ϕ5 to be supplied to the other are made to differ from each other. Specifically, the timing of each of the external pulses ϕ1 to ϕ5 to be supplied to the video signal input circuits 31*a* and 32*a* is changed to the timing shown in FIG. 4 by way of example, and the timing of each of the external pulses ϕ1 to ϕ5 to be supplied to the video signal input circuit 31*b* and 32*b* is changed to the timing shown in FIG. 5 by way of example.

Incidentally, in FIG. 12, reference numerals TG1 to TG18 denote transfer gate circuits, symbol SA denotes a signal line to which to supply each of the external pulses ϕ1 to ϕ5 of the timing shown in FIG. 4, and symbol SB denotes a signal line to which to supply each of the external pulses ϕ1 to ϕ5 of the timing shown in FIG. 5. Symbol SSA denotes a signal line to which to supply a gate switching signal. The transfer gate circuits TG11 and TG12; TG13 and TG14 are alternately turned on by the gate switching signal SSA; whereby the two lines of video signal input circuits are connected to the corresponding video signal line in such a manner as to be alternately switched therebetween from line to line, and the order of connection of the two lines of video signal input circuits to the video signal line is reversed from frame to frame.

Specifically, for example, in the case of the odd-numbered lines of each odd frame, the video signal input circuit 31*a* is connected to the video signal line Dn, and in the case of the even-numbered lines of each odd frame, the video signal input circuit 31*b* is connected to the video signal line Dn. In the case of the odd-numbered lines of each even frame, the video signal input circuit 31*b* is connected to the video signal line Dn, and in the case of the even-numbered lines of each even frame, the video signal input circuit 31*a* is connected to the video signal line Dn.

Incidentally, in the construction shown in FIG. 12, a video signal is alternately inputted to the video signal input circuit 31*a* and the video signal input circuit 31*b* from line to line by the transfer gate circuits TG15 to TG18.

Specifically, when the video signal input circuit 31*a* is connected to the video signal line Dn, a vide signal is inputted to the video signal input circuit 31*b* from the video signal line SO. Thus, although the circuit construction is complicated, the inputting of video signals and the writing of video signals to pixels are separated from each other, the first embodiment is advantageous in timing adjustment or the like.

Incidentally, although the above description of the first embodiment has referred to an embodiment in which the control circuit part 100 and the vertical scanning circuit 110 are incorporated in the liquid crystal display panel, the present invention is not limited to this embodiment, and the control circuit part 100 and the vertical scanning circuit 110 may also be provided at the exterior of the liquid crystal display panel.

Figure 13:
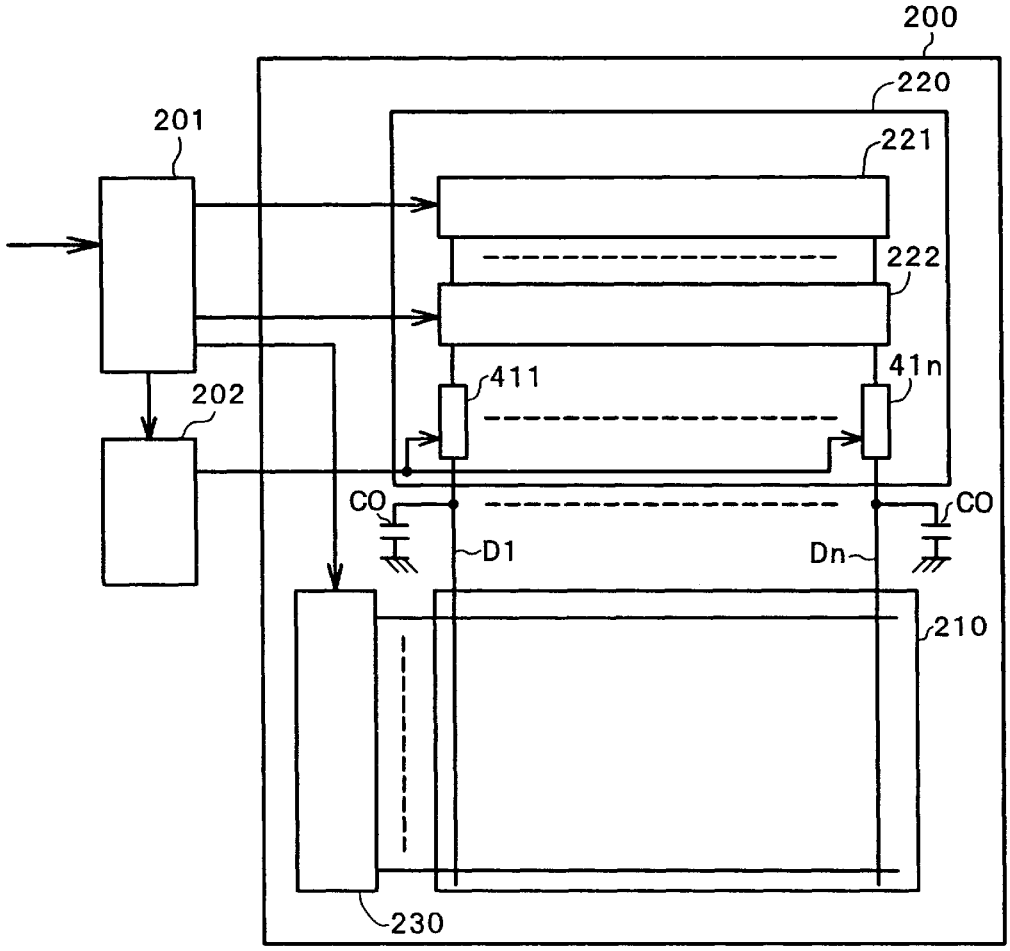
FIG. 13 is a block diagram schematically showing the entire construction of a TFT type of liquid crystal display module according to a second embodiment of the present invention.
Figure 14:
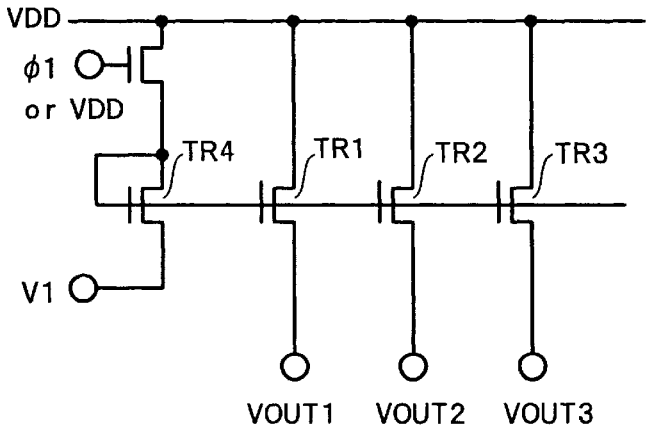
FIG. 14 is a circuit diagram showing one circuit construction for avoiding the shift of the voltage level of a threshold voltage Vth of each MOS transistor.

FIG. 13 is a block diagram schematically showing the entire construction of a TFT type of liquid crystal display module according to a second embodiment of the present invention. The liquid crystal display module according to the second embodiment is a liquid crystal display module in which its video signal is inputted as a digital signal. The liquid crystal display module according to the second embodiment is formed of a liquid crystal display panel 200, a display control device 201 and a control circuit part 202.

The liquid crystal display panel 200 includes a display part 210, a horizontal scanning circuit 220 and a vertical scanning circuit 230. The horizontal scanning circuit 220 includes a memory address selecting circuit (hereinafter referred to as a horizontal shift register circuit) 221, a latch circuit part 222, and video signal input circuits 411 to 41*n*. Each of the video signal input circuits 411 to 41*n* is made of the applied circuit shown in FIG. 6 and the external pulses ϕ1 to ϕ5 of the same timing are inputted to each of the video signal input circuits 411 to 41*n* from the control circuit part 202. The display part 210 of the liquid crystal display panel 200 is identical to that shown in FIG. 9. The display control device 201 is formed of one semiconductor integrated circuit (LSI), and various display control signals, such as clock signals, display timing signals, horizontal synchronizing signals and vertical synchronizing signals, as well as display data R, G and B, are transmitted to the display control device 201 from the body of a computer.

The operation of the liquid crystal display module according to the second embodiment in the case of 3-bit display data will be schematically described below.

When a first display timing signal is inputted to the display control device 201 after a vertical synchronizing signal has been inputted to the same, the display control device 201 determines that this first display timing signal indicates a first display line, and outputs a start pulse SY to the vertical scanning circuit 230. The display control device 201 outputs a vertical driving clock signal CLY, which is a shift clock of one horizontal scanning period, to the vertical scanning circuit 230 so that a positive bias voltage is sequentially applied to each scanning signal line G of the display part 210 every horizontal scanning period on the basis of the horizontal synchronizing signal. Thus, the, vertical scanning circuit 230 sequentially selects a particular scanning signal line G from the scanning signal lines G and outputs a positive bias voltage to the selected scanning signal line G, thereby turning on thin film transistors TFT whose gates are connected to the selected scanning signal line G, for one horizontal scanning period.

When a display timing signal is inputted to the display control device 201, the display control device 201 determines that this display timing signal indicates a display start position, and outputs received 3-bit display data for one simple column to the latch circuit part 222 of the horizontal scanning circuit 220. At the same time, the display control device 201 outputs a start pulse DX and a display data latching clock to the horizontal shift register circuit 221. Thus, the horizontal shift register circuit 221 sequentially outputs a display data inputting shift pulse to the latch circuit part 222.

The latch circuit part 222 sequentially stores display data on the basis of the display data inputting shift pulse, and inputs the display data to the data latch parts (LT1 to LT3 shown in FIG. 6) of the respective video signal input circuits 411 to 41*n*. The data latch parts LT1 to LT3 latch the display data from the latch circuit part 222 before the inputting of the external pulses ϕ1 to ϕ5, and supply video signals to each of the video signal lines D1 to Dn in the procedures described above with reference to FIGS. 7 and 8. Thus, grayscale voltages corresponding to the display data are written to pixels which have the respective thin film transistors TFT whose gates are connected to the selected scanning signal lines G, whereby an image is displayed on the display part 210.

Even in the Poly-SiTr-TFT liquid crystal display module according to the second embodiment, it is possible to cope with either of the aforementioned alternation driving operations, i.e., the common symmetry method or the common inversion method, by changing the timing of each of the external pulses ϕ1 to ϕ5 to be supplied from the control circuit part 202, to the timing shown in FIG. 7 or 8. In addition, if the above-described dot inversion method is to be adopted in the Poly-SiTr-TFT liquid crystal display module according to the second embodiment, it is possible to easily cope with the dot inversion method by, for example, the method shown in FIG. 11.

Specifically, the timing of each of the external pulses ϕ1 to ϕ5 to be supplied to the video signal input circuit 21 provided on the video signal line Dn is changed to the timing shown in FIG. 7 by way of example, and the timing of each of the external pulses ϕ1 to ϕ5 to be supplied to the video signal input circuit 22 provided on the video signal line Dn+1 adjacent to the video signal line Dn is changed to the timing shown in FIG. 8 by way of example. Each of the external pulses ϕ1 to ϕ5 is switched between these timings from line to line and from frame to frame. Moreover, if the aforementioned dot inversion method is to be adopted in the Poly-SiTr-TFT liquid crystal-display module according to the second embodiment, a construction of the type shown in FIG. 12 may also be adopted.

Specifically, the two lines of video signal input circuits 31*a* and 31*b*; 32*a* and 32*b* are provided for each video signal, and the timing of each of the external pulses ϕ1 to ϕ5 to be supplied to the video signal input circuits 31*a* and 32*a* is changed to the timing shown in FIG. 7 by way of example, while the timing of each of the external pulses ϕ1 to ϕ5 to be supplied to the video signal input circuits 31*b* and 32*b* is changed to the timing shown in FIG. 8 by way of example. The two lines of video signal input circuits are connected to the corresponding video signal line in such a manner as to be alternately switched therebetween from line to line, and the order of connection of the two lines of video signal input circuits to the video signal line is reversed from frame to frame. Incidentally, the horizontal scanning circuit 220 and the vertical scanning circuit 230 shown in FIG. 13 are incorporated in the liquid crystal display panel, and are made of Poly-SiTr similarly to the thin film transistors TFT and are formed on the same substrate.

Although the above description of each of the embodiments has referred to embodiments in each of which the present invention is applied to a TFT type of liquid crystal display module using polysilicon transistors, the present invention is not limited to such an embodiment and can be applied to a TFT type of liquid crystal display module using amorphous silicon transistors. Also, although the invention made by the present inventors has been specifically described above on the basis of various embodiments, the present invention is not limited to the above-described embodiments and can, of course, be modified in various manners without departing from the gist of the present invention.

The advantage obtained from a representative aspect of the invention disclosed in the present application is that it is possible to prevent a linear pattern, which occurs on the display screen of a liquid crystal display element, from being influenced by a shift of the threshold voltage of a field-effect transistor which supplies a drive voltage to each pixel, whereby it is possible to improve the display quality of the display screen of the liquid crystal display element.

What is claimed is:

1. A display device comprising:

a latch circuit storing digital data;

a converter circuit converting the digital data stored in the latch circuit to an analog signal;

a voltage regenerating circuit inputting the analog signal and outputting a video signal; and an image signal line supplied with the video signal;

wherein the voltage regenerating circuit comprises a first TFT connected to a first node which is supplied with a first voltage and a second node which is supplied with the analog signal, and a control terminal of the first TFT is inputted with a first timing control signal, a second TFT which is a first conductive type connected to the second node and a third node, and a control terminal of the second TFT is inputted with a second timing control signal, a third TFT connected to the third node and a fourth node, and a control terminal of the third TFT is connected to the second node, a fourth TFT which is a second conductive type connected to the fourth node and a fifth node which is supplied with a second voltage, and a control terminal of the fourth TFT is inputted with the second timing control signal, a fifth TFT which is the first conductive type connected to a sixth node which is supplied with a third voltage and the third node, and a control terminal of the fifth TFT is inputted with a third timing control signal, and a sixth TFT which is the second conductive type connected to the fourth node and a seventh node supplying the video signal to the image signal line, and a control terminal of the sixth TFT is inputted with the third timing control signal.

2. A display device according to claim 1, wherein the first conductive type and the second conductive type are N conductive type.

3. A display device according to claim 2, wherein the first voltage is same as the third voltage.

4. A display device according to claim 1, wherein the first conductive type is P conductive type and the second conductive type is N conductive type.

5. A display device according to claim 2, wherein the first voltage is same as the third.

6. A display device comprising:

a latch circuit storing digital data;

a plurality of converter circuits converting the digital data stored in the latch circuit to a plurality of analog signals;

a plurality of voltage regenerating circuits inputting the plurality of analog signals and outputting a plurality of video signals; and a plurality of image signal lines supplied the plurality of video signals;

wherein each of the voltage regenerating circuits comprises a first TFT connected to a first node which is supplied with a first voltage and a second node which is supplied with one of the plurality of analog signals, and a control terminal of the first TFT is inputted with a first timing control signal, a second TFT which is a first conductive type connected to the second node and a third node, and a control terminal of the second TFT is inputted with a second timing control signal, a third TFT connected to the third node and a fourth node, and a control terminal of the third TFT is connected to the second node, a fourth TFT which is a second conductive type connected to the fourth node and a fifth node which is supplied with a second voltage, and a control terminal of the fourth TFT is inputted with the second timing control signal, a fifth TFT which is the first conductive type connected to a sixth node which is supplied with a third voltage and the third node, and a control terminal of the fifth TFT is inputted with a third timing control signal, and a sixth TFT which is the second conductive type connected to the fourth node and a seventh node supplying one of the plurality of video signals to one of the plurality of image signal lines, and a control terminal of the sixth TFT is inputted with the third timing control signal.

7. A display device according to claim 6, wherein the first conductive type and the second conductive type are N conductive type.

8. A display device according to claim 7, wherein a number of the plurality of image signal lines is same as a number of the plurality of voltage regenerating circuits.

9. A display device according to claim 7, wherein the number of the plurality of voltage regenerating circuits is same as a number of the plurality of converter circuits.

10. A display device according to claim 6, wherein the first conductive type is P conductive type and the second conductive type is N conductive type.

11. A display device according to claim 10, wherein a number of the plurality of image signal lines is same as a number of the plurality of voltage regenerating circuits.

12. A display device according to claim 10, wherein the number of the plurality of voltage regenerating circuits is same as a number of the plurality of converter circuits.

13. A display device comprising:

a latch circuit storing digital data;

a plurality of converter circuits converting the digital data stored in the latch circuit to a plurality of analog signals;

a plurality of voltage regenerating circuits inputting the plurality of analog signals and outputting a plurality of video signals; and a plurality of image signal lines supplied with the plurality of video signals;

wherein each of the voltage regenerating circuits comprises a first TFT connected to a first node which is supplied with a first voltage and a second node, and a control terminal of the first TFT is inputted with a first timing control signal, a second TFT which is a first conductive type connected to the second node and a third node, and a control terminal of the second TFT is inputted with a second timing control signal, a third TFT connected to the third node and a fourth node, and a control terminal of the third TFT is connected to the second node, a fourth TFT which is a second conductive type connected to the fourth node and a fifth node which is supplied with one of the plurality of analog signals, and a control terminal of the fourth TFT is inputted with the second timing control signal, a fifth TFT which is the first conductive type connected to a sixth node which is supplied with a second voltage and the third node, and a control terminal of the fifth TFT is inputted with a third timing control signal, and a sixth TFT which is the second conductive type connected to the fourth node and a seventh node supplying one of the plurality of video signals to one of the plurality of image signal lines, and a control terminal of the sixth TFT is inputted with the third timing control signal.

14. A display device according to claim 13, wherein the first conductive type and the second conductive type are N conductive type.

15. A display device according to claim 14, wherein a number of the plurality of image signal lines is same as a number of the plurality of voltage regenerating circuits.

16. A display device according to claim 14, wherein the number of the plurality of voltage regenerating circuits is same as a number of the plurality of converter circuits.

17. A display device according to claim 13, wherein the first conductive type is P conductive type and the second conductive type is N conductive type.

18. A display device according to claim 17, wherein a number of the plurality of image signal lines is same as a number of the plurality of voltage regenerating circuits.

19. A display device according to claim 17, wherein the number of the plurality of voltage regenerating circuits is same as a number of the plurality of converter circuits.

* * * * *